US009905149B2

(12) United States Patent
Lan et al.

(10) Patent No.: US 9,905,149 B2
(45) Date of Patent: Feb. 27, 2018

(54) DRIVING CIRCUIT, DRIVING METHOD, AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Chuanyan Lan, Beijing (CN); Fucheng Yang, Beijing (CN); Dongmei Wei, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 44 days.

(21) Appl. No.: 15/084,933

(22) Filed: Mar. 30, 2016

(65) Prior Publication Data

US 2017/0032727 A1 Feb. 2, 2017

(30) Foreign Application Priority Data

Jul. 30, 2015 (CN) ..... 2015 1 0461263

(51) Int. Cl.
*G09G 3/36* (2006.01)
*G09G 3/20* (2006.01)

(52) U.S. Cl.
CPC ..... *G09G 3/2007* (2013.01); *G09G 3/3648* (2013.01); *G09G 2310/027* (2013.01); *G09G 2310/0286* (2013.01); *G09G 2310/08* (2013.01); *G09G 2320/0233* (2013.01); *G09G 2320/0247* (2013.01)

(58) Field of Classification Search
None
See application file for complete search history.

(56) References Cited

U.S. PATENT DOCUMENTS

2010/0141850 A1* 6/2010 Itoh ..... G09G 3/3677 348/731
2013/0107152 A1* 5/2013 Okumura ..... G09G 3/3677 349/41

FOREIGN PATENT DOCUMENTS

CN 102929019 A 2/2013
CN 103943085 A 7/2014
CN 104299563 A 1/2015
(Continued)

OTHER PUBLICATIONS

First Chinese Office Action dated Jan. 18, 2017; Appln. No. 201510461263.7.

*Primary Examiner* — Joseph Haley
(74) *Attorney, Agent, or Firm* — Ladas & Parry LLP; Loren K. Thompson

(57) ABSTRACT

Embodiments of the present application disclose a driving circuit, a driving method, and a display device, and pertain to the field of display. The driving circuit comprises: a gate driving unit for sequentially inputting a gate voltage to gates of pixel cells in each row on a display panel, the display panel being divided into a plurality of regions along a gate scanning direction, each region including at least one row of pixel cells controlled by a gate line; and a control unit for controlling the gate driving unit to input different gate voltages to gates in at least two different regions, and to input the same gate voltage to gates in the same region.

15 Claims, 3 Drawing Sheets

(56) References Cited

FOREIGN PATENT DOCUMENTS

| | | | |
|---|---|---|---|
| CN | 104299593 | A | 1/2015 |
| KR | 1020130100682 | A | 9/2013 |

* cited by examiner

DRIVING CIRCUIT, DRIVING METHOD, AND DISPLAY DEVICE

TECHNICAL FIELD

Embodiments of the present application relate to the field of display, and more particularly, to a driving circuit, a driving method, and a display device.

BACKGROUND

An LCD display is mainly composed by three major parts of a display panel, a backlight module, and a driving circuit, the driving circuit includes a gate driving unit, a data driving unit, and other elements. When the LCD display operates, pixel cells on the display panel are scanned progressively by the gate driving unit, once one row is scanned, all pixel cells in this row will be turned on. For instance, the gate driving unit inputs a high level to gates of Thin Film Transistors (referred to as TFTs for short) of the pixel cells to thereby turn on the TFTs, and TFTs will be turned off when the gate driving unit inputs a low level to gates of the TFTs. When the TFTs are turned on, the data driving unit will write a data voltage to the pixel cells in the corresponding row, so that a voltage of the pixel cells is charged to a pixel voltage required to display an image, liquid crystal molecules of the pixel cells deflect by the action of an electric field, thereby light of a backlight source travels through the pixel cells to form an image.

However, in practice, TFTs located in different regions of the display panel are different in properties, this leads to unevenness of displaying of the display cells in different regions, for instance, a grayscale luminance or a flicker degree varies in a different region.

SUMMARY

The embodiments of the present application provide a driving circuit, a driving method, and a display device, for making display effect of pixel cells on the display panel uniform. The technical solutions are as follows:

In a first aspect, an embodiment of the present application provides a driving circuit, wherein the driving circuit comprises:

a gate driving unit for sequentially inputting a gate voltage to gates of pixel cells in each row on a display panel, the display panel being divided into a plurality of regions along a gate scanning direction, each region including at least one row of pixel cells controlled by a gate line; and a control unit for controlling the gate driving unit to input different gate voltages to gates in at least two different regions, and to input the same gate voltage to gates in the same region.

In an implementation of the embodiment of the present application, the driving circuit further comprises: a data driving unit for, when gates in each row are turned on, inputting a data voltage to sources of pixel cells in the corresponding row.

In another implementation of the embodiment of the present application, the regions are divided according to a flicker degree or a grayscale luminance of pixel cells on the display panel in a test scenario;

in the test scenario, the gate driving unit inputs the same gate voltage to gates of pixel cells in each row, the data driving unit inputs the same data voltage to sources of the pixel cells in each row.

In another implementation of the embodiment of the present application, the display panel is divided into 3 to 10 regions.

In another implementation of the embodiment of the present application, along the gate scanning direction, the gate voltage inputted to the gates in each region increases gradually.

In another implementation of the embodiment of the present application, along the gate scanning direction, the gate voltage inputted to the gates in each region first increases and then decreases.

In a second aspect, an embodiment of the present application further provides a driving method, wherein the method comprises:

sequentially inputting a gate voltage to gates of pixel cells in each row on a display panel, the display panel being divided into a plurality of regions along a gate scanning direction, each region including at least one row of pixel cells; and inputting different gate voltages to gates in at least two different regions, and inputting the same gate voltage to gates in the same region.

In an implementation of the embodiment of the present application, the method further comprises:

when gates in each row are turned on, inputting a data voltage to sources of pixel cells in the corresponding row.

In another implementation of the embodiment of the present application, the regions are divided according to a flicker degree or a grayscale luminance of pixel cells on the display panel in a test scenario;

in the test scenario, the same gate voltage is inputted to gates of pixel cells in each row, the same data voltage is inputted to sources of the pixel cells in each row.

In another implementation of the embodiment of the present application, the display panel is divided into 3 to 10 regions.

In another implementation of the embodiment of the present application, along the gate scanning direction, the gate voltage inputted to the gates in each region increases gradually.

In another implementation of the embodiment of the present application, along the gate scanning direction, the gate voltage inputted to the gates in each region first increases and then decreases.

In a third aspect, an embodiment of the present application further provides a display device, wherein the display device comprises any of the driving circuit as described above.

Beneficial effects brought by the technical solutions provided by the embodiments of the present application are:

In the embodiments of the present application, when performing gate driving, the control unit controls the gate driving unit to input different gate voltages to gates in different regions and to input the same gate voltage to gates in the same region, since TFTs located in different regions of the display panel are different in properties, it leads to unevenness of displaying of the display cells in different regions, thus inputting different gate voltages to gates in different regions can generate compensation in different degrees for respective regions, thereby alleviate unevenness of displaying of display cells on the display panel.

BRIEF DESCRIPTION OF THE DRAWINGS

In order to more clearly illustrate the technical solutions in the embodiments of the present application, drawings necessary for describing the embodiments will be briefly introduced below, obviously, for those of ordinary skill in the art, it is possible to attain other drawings based on these drawings without paying creative effort.

DETAILED DESCRIPTION OF THE EMBODIMENTS

For the objects, technical solutions, and advantages of the present application to be more apparent, hereinafter, implementations of the present application will be described in detail in conjunction with the drawings attached thereto.

Figure 1:
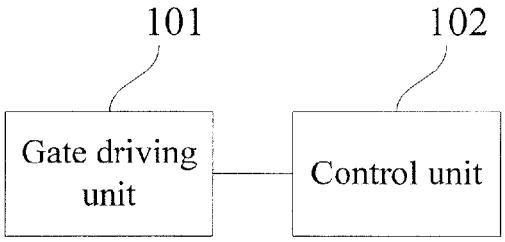
FIG. 1 is a schematic diagram of configuration of a driving circuit according to an embodiment of the present application.

FIG. 1 is a schematic diagram of configuration of a driving circuit according to an embodiment of the present application, referring to FIG. 1, the driving circuit comprises:

a gate driving unit 101 for sequentially inputting a gate voltage to gates of pixel cells in each row on a display panel, the display panel being divided into a plurality of regions along a gate scanning direction, each region including at least one row of pixel cells controlled by a gate line; and a control unit 102 for controlling the gate driving unit 101 to input different gate voltages to gates in at least two different regions, and to input the same gate voltage to gates in the same region.

It is easy to understand that, the display panel comprises a display region and a driving region, the driving circuit is provided in the driving region of the display panel, the display region of the display panel comprises a plurality of pixel cells arranged in rows, each pixel cell includes a TFT switch, the TFT switch has a gate, a source, and a drain, the gate driving unit 101 sequentially inputs a gate voltage to gates of pixel cells in each row on the display panel.

In the embodiment of the present application, when performing gate driving, the control unit controls the gate driving unit to input different gate voltages to gates in different regions, and to input the same gate voltage to gates in the same region, since TFTs located in different regions of the display panel are different in properties, it leads to unevenness of displaying of the display cells in different regions, thus inputting different gate voltages to gates in different regions can generate compensation in different degrees for respective regions, thereby alleviate unevenness of displaying of display cells on the display panel.

Figure 2:
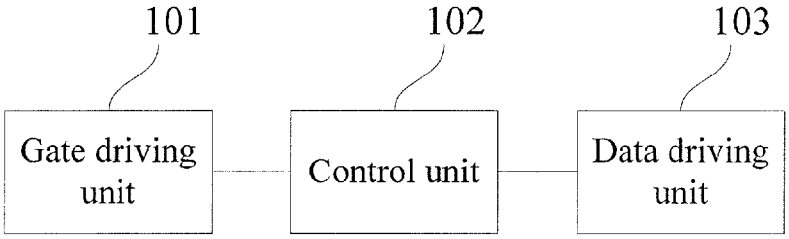
FIG. 2 is a schematic diagram of configuration of a driving circuit according to an embodiment of the present application.

FIG. 2 is a schematic diagram of configuration of a driving circuit provided by an embodiment of the present application, in comparison to the driving circuit provided in FIG. 1, the driving circuit according to this embodiment further comprises a data driving unit 103 for, when gates in each row are turned on, inputting a data voltage to sources of pixel cells in the corresponding row.

In the embodiment of the present application, the regions are divided according to a flicker degree or a grayscale luminance of pixel cells on the display panel in a test scenario;

in the test scenario, the gate driving unit 101 inputs the same gate voltage to gates of pixel cells in each row, the data driving unit 103 inputs the same data voltage to sources of the pixel cells in each row.

Accordingly, during actual driving, the gate voltages provided by the gate driving unit 101 to the gates in a plurality of regions are for, when the data voltages inputted to the sources of the pixel cells in each row are the same, controlling a display parameter in the plurality of regions to be the same, the display parameter includes a flicker degree or a grayscale luminance, i.e., when the data voltages inputted to the sources of the pixel cells in each row are the same, the flicker degree or the grayscale luminance in the plurality of regions is the same, which thereby ensures uniformity of displaying of pixel cells on the display panel.

The manner of dividing mainly comprises two types. First type, an operator judges the flicker degree or the grayscale luminance by naked eyes, then divides regions according to the flicker degree or the grayscale luminance observed.

Second type, first, a device for detecting the flicker degree or the grayscale luminance is adopted to detect the flicker degree or the grayscale luminance in respective parts on the display panel, then the flicker degree or the grayscale luminance of the pixel cells along the gate scanning direction is calculated, and thereafter consecutive pixel cells located in the same range are divided into one region according to a range of flicker degree or grayscale luminance divided in advance.

On basis of the second type, in order to achieve automatic control, the device for detecting may be electrically connected with the control unit 102. For instance, the device for detecting is for detecting the flicker degree or the grayscale luminance in various parts of the display panel, and transmitting a detection result to the control unit 102; the control unit 102 is for, according to the detection result, dividing consecutive pixel cells located in the same range into one region according to a range of flicker degree or grayscale luminance divided in advance.

In addition, the control unit 102 is further for, according to the flicker degree or the grayscale luminance in each region, controlling the gate voltages outputted by the gate driving unit 101. For instance, the control unit 102 may, according to the flicker degree or the grayscale luminance of each region together with a target flicker degree or a target grayscale luminance, regulate gate voltages outputted to respective regions the last time. For instance, when the flicker degree or the grayscale luminance in one region is larger (smaller) than the target flicker degree or the target grayscale luminance, a voltage value is reduced (or increased) on basis of the gate voltage outputted to this region the last time, the voltage value by which increase or decrease is made each time may be a predetermined value. When the flicker degree or the grayscale luminance of this region is equal to the target flicker degree or the target grayscale luminance, the gate voltage outputted to this region last time is outputted to this region.

For instance, the control unit 102 transmits a timing signal and a gate signal to the gate driving unit 101, the timing signal is for controlling the gate driving unit 101 to sequentially output from different output pins connected to pixel cells in different rows on the display panel, the gate signal is for indicating a gate voltage outputted by a different output pin of the gate driving unit 101. Here, the gate signal may be multi-bit binary data, e.g., 7 bits.

Figure 3:
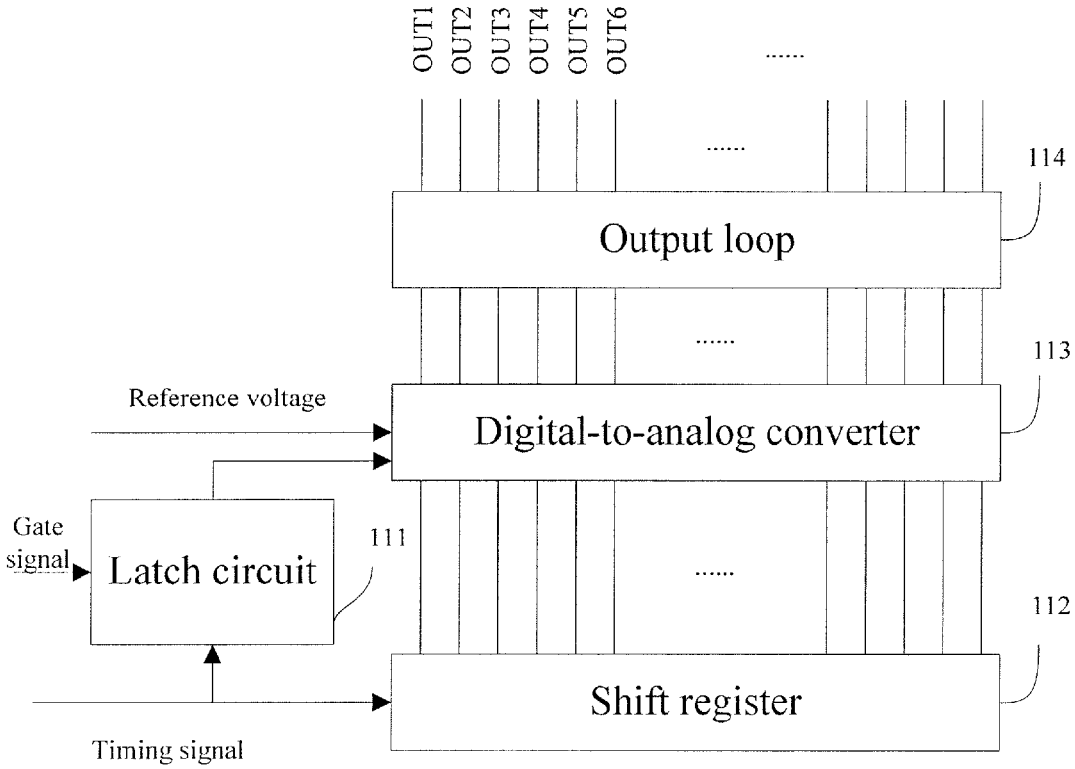
FIG. 3 is a schematic diagram of configuration of a gate driving unit according to an embodiment of the present application.

For instance, referring to FIG. 3, the gate driving unit 101 may comprise: a latch circuit 111 for receiving and storing the gate signal transmitted by the control unit 102; a shift register 112 for controlling, according to the timing signal, the gate driving unit 101 to output from different pins; a digital-to-analog converter 113 for performing digital to analog conversion based on a reference voltage, and converting a gate signal into a corresponding gate voltage to output; and an output loop 114 for performing processing such as impedance change, filtering on the gate voltage, thereafter outputting the same from the corresponding pin (e.g., OUT1 to OUT6 in FIG. 3).

For instance, the data signal is 7-bit binary data, the digital-to-analog converter 113 is a 7-bit digital-to-analog converter, the reference voltage supplied externally is a 10-stage voltage reference V1 to V10. The digital-to-analog converter 113 uses the first 4 bits of the data signal to select one from among V1 to V10, then divides the selected voltage into 8 equal portions, and thereafter uses the last 3 bits of the data signal to select one among the equally-divided voltages as the gate voltage to output.

Of course, the gate driving unit 101 described above is merely an example, the gate driving unit 101 according to the present application may also be implemented with other configurations.

In the embodiment of present application, the display panel may be divided into 3 to 10 regions. Dividing the display panel into 3 to 10 regions can effectively control uniformity of the flicker degree or the grayscale luminance and guarantee accuracy thereof, without complicating the control over the gate voltage too much.

In an implementation of the embodiment of the present application, along the gate scanning direction, the gate voltage inputted to the gates in each region increases gradually. Since the grayscale luminance of the display panel gradually darkens along the scanning direction, such setting of gradually increasing the gate voltage therefore can be adopted to regulate the grayscale luminance.

Figure 4:
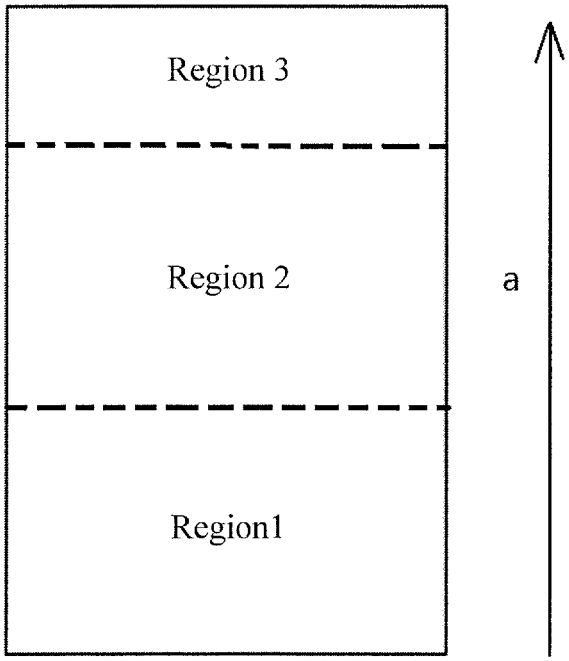
FIG. 4 is a schematic diagram of region division provided by an embodiment of the present application.

For instance, FIG. 4 shows a schematic diagram of region division, wherein the display panel includes 800 rows, for instance, region 1 includes rows G1 to Gm−1, region 2 includes rows Gm to Gn−1, region 3 includes rows Gn to G800, wherein m, n are a positive integer each, and $m<n<800$.

Figure 5:
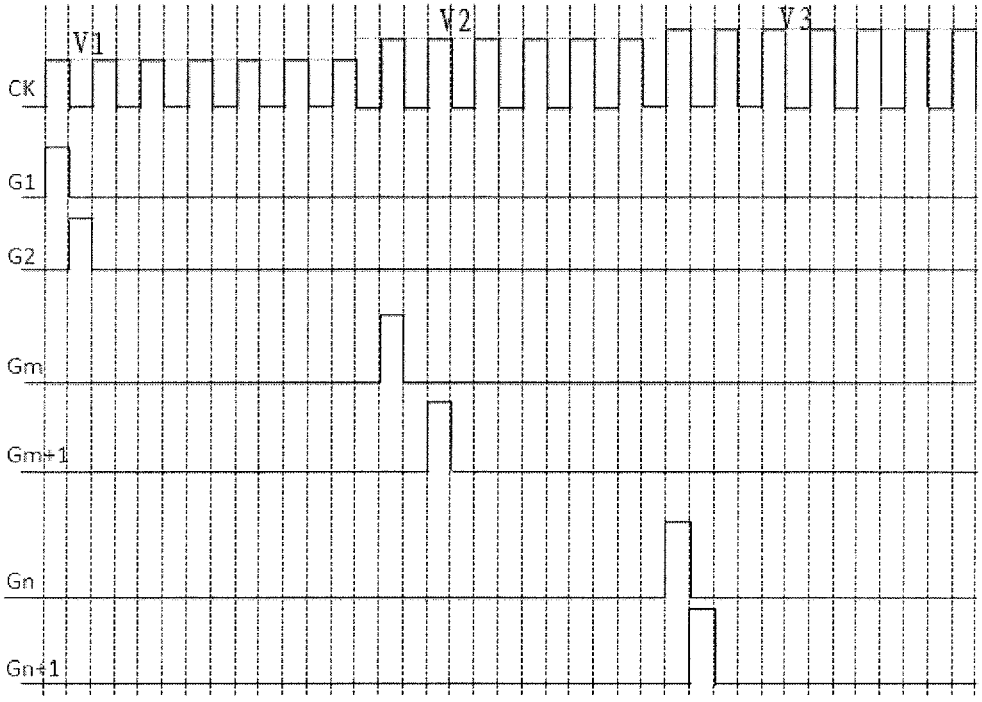
FIG. 5 is a schematic diagram of a gate voltage provided by an embodiment of the present application.

On basis of region division in FIG. 4, FIG. 5 provides a schematic diagram of a gate voltage of each region in FIG. 4, wherein CK is a pulse signal that provides the gate voltage. For instance, the gate voltage of pixel cells in each row of region 1 is V1, the gate voltage of pixel cells in each row of region 2 is V2, the gate voltage of pixel cells in each row of region 3 is V3. Since the gate voltage gradually increases from region 1 to region 3, so that it can achieve uniformity of displaying of the grayscale luminance.

In another implementation of the embodiment of the present application, along the gate scanning direction, the gate voltage inputted to the gates in each region first increases and then decreases. Typically, the flicker degree of the display panel is poor in the middle and good in four corners, so that such setting of first increasing the gate voltage and then decreasing the gate voltage can be adopted to regulate the flicker degree.

For instance, the gate driving unit described above may be a gate driving unit in the conventional display device, the data driving unit may be a data driver, the control unit may be a control integrated circuit (referred to as IC for short) chip. Of course, the driving circuit may also comprise other common elements such as a timing controller, the embodiment of the present application makes no limitations thereto.

Figure 6:
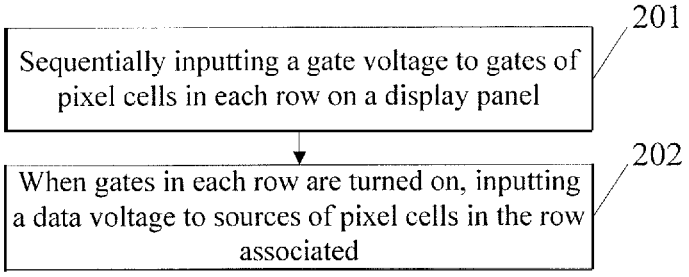
FIG. 6 is a flowchart of a driving method provided by an embodiment of the present application.

FIG. 6 is a flowchart of a driving method provided by an embodiment of the present application, referring to FIG. 6, the method comprises:

step 201: sequentially inputting a gate voltage to gates of pixel cells in each row on a display panel, the display panel being divided into a plurality of regions along a gate scanning direction, each region including at least one row of pixel cells.

For instance, different gate voltages are inputted to gates in at least two different regions, and the same gate voltage is inputted to gates in the same region.

In the embodiment of the present application, the regions are divided according to a flicker degree or a grayscale luminance of pixel cells on the display panel in a test scenario;

in the test scenario, the same gate voltage is inputted to gates of pixel cells in each row, the same data voltage is inputted to sources of the pixel cells in each row.

Accordingly, during actual driving, the gate voltages provided to the gates in a plurality of regions are for, when the data voltages inputted to the sources of the pixel cells in each row are the same, controlling a display parameter in the plurality of regions to be the same, the display parameter includes a flicker degree or a grayscale luminance, i.e., when the data voltages inputted to the sources of the pixel cells in each row are the same, the flicker degree or the grayscale luminance in the plurality of regions is the same, which thereby ensures uniformity of displaying of pixel cells on the display panel.

The manner of dividing mainly comprises two types. First type, an operator judges the flicker degree or the grayscale luminance by naked eyes, then divides regions according to the flicker degree or the grayscale luminance observed.

Second type, a device for detecting the flicker degree or the grayscale luminance is adopted to first detect the flicker degree or the grayscale luminance in respective parts on the display panel, then calculate the flicker degree or the grayscale luminance of the pixel cells along the gate scanning direction, and thereafter divide consecutive pixel cells located in the same range into one region according to a range of flicker degree or grayscale luminance divided in advance.

In the embodiment of the present application, the regions are divided according to a flicker degree or a grayscale luminance of pixel cells on the display panel when the same gate voltage is inputted to gates of pixel cells in each row, the same data voltage is inputted to sources of the pixel cells in each row.

In the embodiment of present application, the display panel may be divided into 3 to 10 regions. Dividing the display panel into 3 to 10 regions can effectively control uniformity of the flicker degree or the grayscale luminance and guarantee accuracy thereof, without complicating the control over the gate voltage too much.

In an implementation of the embodiment of the present application, along the gate scanning direction, the gate voltage inputted to the gates in each region increases gradually. Since the grayscale luminance of the display panel gradually darkens along the scanning direction, such setting of gradually increasing the gate voltage therefore can be adopted to regulate the grayscale luminance.

For instance, FIG. 4 shows a schematic diagram of region division, wherein the display panel includes 800 rows, for instance, region 1 includes rows G1 to Gm−1, region 2 includes rows Gm to Gn−1, region 3 includes rows Gn to G800, wherein m, n are a positive integer each, and m<n<800.

On basis of region division in FIG. 4, FIG. 5 provides a schematic diagram of a gate voltage of each region in FIG. 4, wherein CK is a pulse signal that provides the gate voltage. For instance, the gate voltage of pixel cells in each row of region 1 is V1, the gate voltage of pixel cells in each row of region 2 is V2, the gate voltage of pixel cells in each row of region 3 is V3. Since the gate voltage gradually increases from region 1 to region 3, so that it can achieve uniformity of displaying of the grayscale luminance.

In another implementation of the embodiment of the present application, along the gate scanning direction, the gate voltage inputted to the gates in each region first increases and then decreases. Typically, the flicker degree of the display panel is poor in the middle and good in four corners, so that such setting of first increasing the gate voltage and then decreasing the gate voltage can be adopted to regulate the flicker degree.

In addition, the method further comprises:

step 202: when gates in each row are turned on, inputting a data voltage to sources of pixel cells in the corresponding row.

In the embodiment of the present application, when performing gate driving, the control unit controls the gate driving unit to input different gate voltages to gates in different regions, and to input the same gate voltage to gates in the same region, since TFTs located in different regions of the display panel are different in properties, it leads to unevenness of displaying of the display cells in different regions, thus inputting different gate voltages to gates in different regions can generate compensation in different degrees for respective regions, thereby alleviate unevenness of displaying of the display cells on the display panel.

Based on the same inventive concept, an embodiment of the present application further provides a display device, the display device comprising the driving circuit provided in the foregoing embodiments.

In specific implementation, the display device according to the embodiment of the present application may be any product or component with a display function, such as mobile phone, tablet computer, television, monitor, notebook computer, digital picture frame, navigation system etc.

The above are merely preferred embodiments of the present application, not intended to limit the present application, any modifications, equivalent substitution, improvement and so on made within the spirits and principles of the present application all fall into the protection scope of the present application.

What is claimed is:

1. A driving circuit, comprising:

a gate driving unit for sequentially inputting a gate voltage to gates of pixel cells in each row on a display panel, the display panel being divided into a plurality of regions along a gate scanning direction, each region including at least one row of pixel cells controlled by a gate line;

a control unit for controlling the gate driving unit to input different gate voltages to gates in at least two different regions, and to input the same gate voltage to gates in the same region; and a data driving unit for, when gates in each row are turned on, inputting a data voltage to sources of pixel cells in the corresponding row, wherein the regions are divided according to a flicker degree or a grayscale luminance of pixel cells on the display panel in a test scenario.

2. The driving circuit according to claim 1, wherein in the test scenario, the gate driving unit inputs the same gate voltage to gates of pixel cells in each row, the data driving unit inputs the same data voltage to sources of the pixel cells in each row.

3. The driving circuit according to claim 1, wherein the display panel is divided into 3 to 10 regions.

4. The driving circuit according to claim 3, wherein along the gate scanning direction, the gate voltage inputted to the gates in each region increases gradually.

5. The driving circuit according to claim 3, wherein along the gate scanning direction, the gate voltage inputted to the gates in each region first increases and then decreases.

6. A driving method, comprising:

sequentially inputting a gate voltage to gates of pixel cells in each row on a display panel, the display panel being divided into a plurality of regions along a gate scanning direction, each region including at least one row of pixel cells;

inputting different gate voltages to gates in at least two different regions, and inputting the same gate voltage to gates in the same region;

when gates in each row are turned on, inputting a data voltage to sources of pixel cells in the corresponding row, wherein the regions are divided according to a flicker degree or a grayscale luminance of pixel cells on the display panel in a test scenario.

7. The method according to claim 6, wherein in the test scenario, the same gate voltage is inputted to gates of pixel cells in each row, the same data voltage is inputted to sources of the pixel cells in each row.

8. The method according to claim 6, wherein the display panel is divided into 3 to 10 regions.

9. The method according to claim 8, wherein along the gate scanning direction, the gate voltage inputted to the gates in each region increases gradually.

10. The method according to claim 8, wherein along the gate scanning direction, the gate voltage inputted to the gates in each region first increases and then decreases.

11. A display device, wherein the display device comprises the driving circuit according to claim 1, the driving circuit further comprises: a data driving unit for, when gates in each row are turned on, inputting a data voltage to sources of pixel cells in the corresponding row, wherein the regions are divided according to a flicker degree or a grayscale luminance of pixel cells on the display panel in a test scenario.

12. The display device according to claim 11, in the test scenario, the gate driving unit inputs to the same gate voltage to gates of pixel cells in each row, the driving unit inputs the same data voltage to sources of the pixel cells in each row.

13. The display device according to claim 11, wherein the display panel is divided into 3 to 10 regions.

14. The display device according to claim 13, wherein along the gate scanning direction, the gate voltage inputted to the gates in each region increases gradually.

15. The display device according to claim 13, wherein along the gate scanning direction, the gate voltage inputted to the gates in each region first increases and then decreases.

* * * * *